US011091854B2

(12) United States Patent
Stephan

(10) Patent No.: US 11,091,854 B2
(45) Date of Patent: Aug. 17, 2021

(54) METHOD FOR OPERATING A TEXTILE MACHINE, AND TEXTILE MACHINE

(71) Applicant: Maschinenfabrik Rieter AG, Winterthur (CH)

(72) Inventor: Adalbert Stephan, Beilngries/Paulushofen (DE)

(73) Assignee: Maschinenfabrik Rieter AG, Winterthur (CH)

( * ) Notice: Subject to any disclaimer, the term of this patent is extended or adjusted under 35 U.S.C. 154(b) by 44 days.

(21) Appl. No.: 16/527,254

(22) Filed: Jul. 31, 2019

(65) Prior Publication Data

US 2020/0040487 A1 Feb. 6, 2020

(30) Foreign Application Priority Data

Aug. 1, 2018 (DE) ..... 10 2018 118 654.1

(51) Int. Cl.

| | |
|---|---|
| ***D01H 1/20*** | (2006.01) |
| ***D01H 7/00*** | (2006.01) |
| ***D01H 4/42*** | (2006.01) |
| ***B65H 63/00*** | (2006.01) |

(52) U.S. Cl.

CPC ..... *D01H 1/20* (2013.01); *B65H 63/00* (2013.01); *D01H 4/42* (2013.01); *D01H 7/00* (2013.01)

(58) Field of Classification Search

CPC ..... D01H 1/20; D01H 4/42; D01H 7/00

See application file for complete search history.

(56) References Cited

U.S. PATENT DOCUMENTS

| | | | | |
|---|---|---|---|---|
| 3,882,663 A * | 5/1975 | Soukup | D01H 4/42 | 57/263 |
| 3,908,134 A * | 9/1975 | Mikulecky | D01H 4/42 | 307/154 |
| 4,532,759 A * | 8/1985 | Bischofberger | B65H 54/26 | 242/473.6 |
| 5,394,334 A * | 2/1995 | Simon | B65H 63/00 | 57/264 |

(Continued)

FOREIGN PATENT DOCUMENTS

| | | |
|---|---|---|
| DE | 10 2007 043 417 A1 | 3/2009 |
| DE | 10 2013 111 647 A1 | 4/2015 |

(Continued)

OTHER PUBLICATIONS

Machine Translation DE102015014429 , Retrieved Nov. 6, 2020.*
German Patent Office Search Report, dated Mar. 8, 2019.
EPO Search Report, dated Dec. 12, 2019.

*Primary Examiner* — Shaun R Hurley
(74) *Attorney, Agent, or Firm* — Dority & Manning, P.A.

(57) ABSTRACT

A method is provided for operating a textile machine having a plurality of identical workstations wherein, during a normal operation of the workstations, yarn is produced or rewound from a supply bobbin onto a receiving bobbin at the workstations. After a stoppage at a plurality of the work stations, the method includes starting and setting the plurality of workstation into a normal operating mode. The method includes dividing the plurality of workstations into groups of workstations, and starting up the groups of workstations at different predefined times, such as predefined waiting times between consecutive groups of the work stations.

11 Claims, 2 Drawing Sheets

(56) References Cited

U.S. PATENT DOCUMENTS

| | | | | | |
|---|---|---|---|---|---|
| 5,590,045 | A * | 12/1996 | Kaak | D01H 13/32 | 57/264 |
| 6,536,199 | B2 * | 3/2003 | Wortmann | D01H 1/16 | 57/264 |
| 2004/0024484 | A1 * | 2/2004 | Bahlmann | D01H 13/26 | 700/130 |
| 2016/0299490 | A1 * | 10/2016 | Gruber | D01H 1/20 | |
| 2017/0283993 | A1 * | 10/2017 | Stephan | D01H 15/00 | |

FOREIGN PATENT DOCUMENTS

| | | | | |
|---|---|---|---|---|
| DE | 10 2015 012 214 | A1 | 3/2017 | |
| DE | 102015014429 | A1 * | 5/2017 | B65H 54/74 |
| DE | 10 2016 106 107 | A1 | 10/2017 | |
| EP | 3 144 418 | A1 | 3/1917 | |
| EP | 3 168 179 | A1 | 5/2017 | |

* cited by examiner

METHOD FOR OPERATING A TEXTILE MACHINE, AND TEXTILE MACHINE

FIELD OF THE INVENTION

The present invention relates to a method for operating a textile machine, in particular a textile machine producing cross-wound bobbins, most particularly an open-end spinning machine, having a plurality of identical workstations. During a normal operation of the workstations, yarn is produced or rewound from a supply bobbin onto a receiving bobbin with the aid of the workstations. A plurality of workstations, after a stoppage of these workstations, is started and therefore, set into the normal operating mode. Moreover, the invention relates to a textile machine, in particular a textile machine producing cross-wound bobbins, most particularly an open-end spinning machine, comprising a plurality of identical workstations for producing yarn or for rewinding yarn from a supply bobbin onto a receiving bobbin.

BACKGROUND

Methods of the generic type for operating a textile machine and textile machines of the generic type are well known. A problem to be solved, in particular given the increasing automation of textile machines, is the rapid start-up of a plurality of workstations, for example, after a scheduled machine stoppage, after a lot change, or after a power failure. A rapid start-up ensures that the workstations can rapidly begin their normal operation and are quickly productive again. Therefore, a simultaneous start-up of all workstations would be ideal. This usually fails, however, due to the fact that certain resources, such as (electrical) energy, compressed air, or vacuum, which are required for starting the workstations, are available only in limited amounts. For this reason, a simultaneous start-up of all workstations is not feasible.

One possible method, which takes the limited resources into consideration, is disclosed in the German patent application DE 10 2016 106 107 A1. In this method, the service operations, which initiate the normal operation at the individual workstations, are subdivided into multiple sub-sequences. Although this method makes highly efficient use of the available resources, it is also complicated and requires a powerful control unit, which carries out the distribution of the individual sub-sequences and the coordination of the distribution.

SUMMARY

A problem addressed by the present invention is therefore that of providing a method for operating a textile machine, as well as the textile machine, which provide for a rapid start-up of a plurality of workstations but are also simple and uncomplicated.

The problem is solved by a method for operating a textile machine as well as a textile machine having the features set forth herein.

Additional objects and advantages of the invention will be set forth in part in the following description, or may be obvious from the description, or may be learned through practice of the invention.

The invention relates to a method for operating a textile machine comprising a plurality of identical workstations. This can be any type of textile machine, in principle, provided it comprises a plurality of identical workstations, in particular, however, a textile machine producing cross-wound bobbins. Most particularly, an open-end spinning machine or an air-jet spinning machine are mentioned as possible textile machines.

Depending on the textile machine, the workstations produce yarn during a normal operation (spinning machines) or the workstations rewind yarn from a supply bobbin onto a receiving bobbin (winders). After a stoppage of the workstations, for example, after a scheduled machine stoppage, after a lot change, or after a power failure, a plurality of workstations is started and, therefore, set into the normal operating mode.

According to the invention, the plurality of workstations is divided into groups of workstations and the groups of workstations are started at different times. Due to the time offset of the start-up, resources of the textile machine are likewise required at different times, and so the available resources suffice for starting the individual groups of workstations one after the other. It is not necessary for a first group of workstations to have already started the normal operation when the next group of workstations starts; rather, a small time offset is usually sufficient. This method is simple as well as uncomplicated and allows for a rapid start-up of a plurality of workstations.

A group of workstations can encompass, for example, fewer than ten workstations, preferably fewer than five workstations (for example, two workstations).

Advantageously, the time offset between the start-up of consecutive groups of workstations is a predefinable waiting time. It is also conceivable that the waiting time is predefined by the manufacturer of the textile machine, or that operating personnel of the textile machine can adjust this waiting time. Since the sequence of the start-up operations of the individual workstations and, therefore, the consumption of resources are essentially equal, a predefinable waiting time allows for a rapid start-up of the workstations using a very simple method. The waiting time can preferably be less than 5 s (seconds), particularly preferably less than 1 s (second).

It is also advantageous when the time offset between the start-up of consecutive groups of workstations is determined as a function of status data of the textile machine. Although a certain safety reserve of resources must be maintained during the start-up of the workstations with a predefinable waiting time, it is possible to reduce the required safety reserve and, therefore, achieve an even faster start-up of the individual groups of workstations by determining the status data of the textile machine.

It is advantageous when the plurality of workstations is divided into fixedly predefinable groups of workstations. Examples of groups of workstations are physically contiguous workstations, for example, the workstations of one section or one section side. It is also conceivable, however, to select one workstation from each section as a group of workstations, to select another workstation from each section as the next group, etc. This is advantageous, in particular, when shortages occur in the distribution of resources to the individual sections. Due to the fixedly predefinable groups of workstations, a very simple implementation of the method is given.

Advantageously, the plurality of workstations is divided into groups of workstations, which are determined as a function of status data of the textile machine. In this way, it is possible, for example, to create groups of workstations having approximately the same size, even if only a few workstations of one section and almost all workstations of another section must be started up. Depending on the available resources, the size of the groups can also be adjusted, wherein the size of the group is that much smaller when fewer resources are available. This somewhat more complicated method results in an even faster start-up of the workstations.

It is advantageous when the sequence, in which the groups of workstations are started, is predefinable. For example, groups of workstations situated next to one another can also be started one after the other. Alternatively, groups of workstations, which are as far apart from one another as possible, can be started one after the other. In the latter case, the heating, which occurs during the start-up of workstations, is better distributed onto the textile machine. In any case, a predefinable sequence for the start-up of the groups of workstations results in a very simple method for operating the textile machine.

It is also advantageous when the sequence in which the groups of workstations are started is determined as a function of status data of the textile machine. This is advantageous, in particular, when the groups of workstations are fixedly predefinable and some groups encompass many workstations to be started and other groups encompass few workstations to be started. The available resources can be utilized in an optimal manner in this case by making a clever selection of the sequence of the start-up of the groups.

Finally, it is advantageous when the status data encompass resources of the textile machine, in particular, energy, compressed air, and/or vacuum, and/or parameters of the spun or wound yarn. The available resources are frequently the limiting factor for the rapid start-up of a plurality of workstations. A precise knowledge of the available resources, as well as of the resources that have already been consumed, is therefore essential for an optimal utilization of the resources. Even when the spun or wound yarn has various properties, for example, a different thickness, this results, for example, in different time durations of the start-up operation and/or a different consumption of resources. Consequently, the knowledge of parameters of the spun or wound yarn also results in a faster start-up of the workstations of the textile machine.

Moreover, a textile machine is provided, which comprises a plurality of identical workstations for producing yarn or for rewinding yarn from a supply bobbin onto a receiving bobbin. The textile machine is therefore a spinning machine or a winder, in particular a textile machine producing cross-wound bobbins, and most particularly an open-end spinning machine. Other textile machines comprising a plurality of identical workstations, such as air-jet spinning machines, are also encompassed by the invention, however.

According to the invention, the textile machine comprises control means or is operatively connected to control means, which are designed for operating the textile machine in accordance to the methods discussed above. In particular, therefore, when a plurality of workstations is to be started, after a stoppage of these workstations, and, therefore, is to be set into a normal operating mode, the plurality of workstations is divided into groups of workstations and the groups of workstations are started at different times. In this way, a simple yet efficient operation of the textile machine results.

Advantageously, the control means are one central control unit or multiple central control units. In the central control unit, the information necessary for the operation of the textile machine flows together, which allows for a best-possible operation of the textile machine.

Finally, it is advantageous when the textile machine comprises sensors and/or measuring units for gathering status data of the textile machine. Due to the knowledge of this status data, the operation of the textile machine can be further optimized. Preferably, the sensors and/or measuring units are connected to the control means. In this way, the status data of the textile machine can be easily transmitted to the control means.

The textile machine is operated according to the preceding description and is designed according to the preceding description, wherein the mentioned features can be present individually or in any combination.

BRIEF DESCRIPTION OF THE DRAWINGS

Further advantages of the invention are described in the following exemplary embodiments. Wherein.

DETAILED DESCRIPTION

Figure 1:
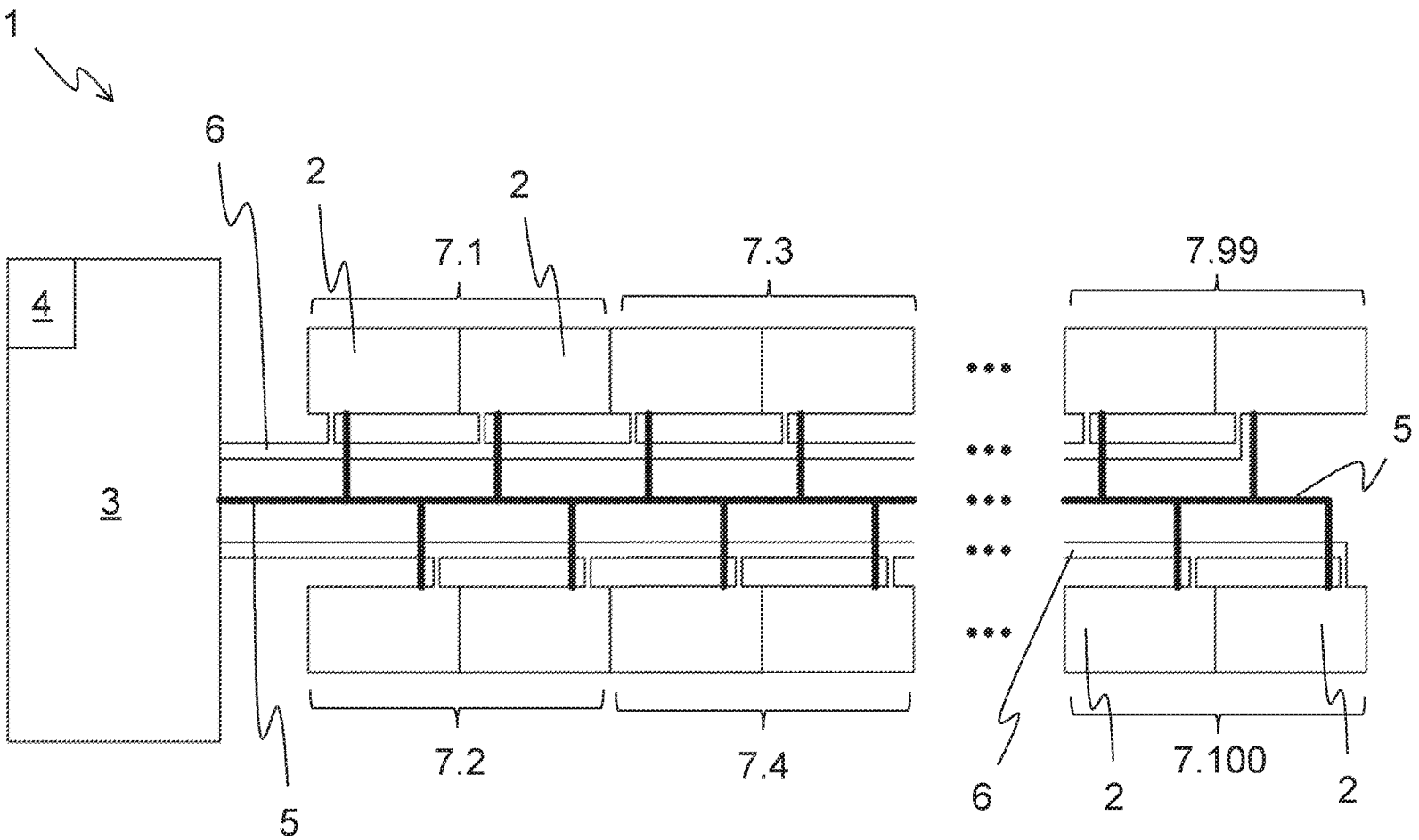
FIG. 1 shows a schematic top view of a textile machine.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic top view of a textile machine 1 according to the invention, comprising a plurality of identical workstations 2, of which only a few are provided with a reference numeral, for the sake of clarity.

The textile machine 1 can be any type of textile machine 1, which comprises a plurality of identical workstations 2, in particular a spinning machine or winder.

Particularly noteworthy are textile machines 1 producing cross-wound bobbins and, in this case, in particular, open-end spinning machines and air-jet spinning machines.

Moreover, the textile machine 1 comprises a machine head 3, which includes a central control unit 4. Not shown here is an alternative exemplary embodiment, which operates the textile machine 1 with the aid of decentralized control means rather than the central control unit 4.

The machine head 3 supplies the workstations 2 with electrical energy and compressed air via power cables 5 and compressed air pipes 6, respectively. Other resources, such as vacuum, can also be required by the workstations 2.

When the start-up of a plurality of workstations 2 is necessary, for example, after a scheduled machine stoppage, after a lot change, or after a power failure, the workstations 2 are initially divided into groups 7 of workstations 2. The various groups have been labeled here as 7.1, 7.2, etc. In this exemplary embodiment, a group 7 of workstations 2 consists of two workstations 2. A greater number of workstations 2 per group 7 is also conceivable, however, and it is also conceivable that the number of workstations 2 per group 7 is not the same for all groups 7.

If the workstations 2 assigned to the groups 7.1 to 7.100 are now to be started, the workstations 2 of the group 7.1 are started first. The workstations 2 of the group 7.2 are then started with a time offset with respect to the workstations 2 of the group 7.1. Due to this time offset, not all resources are required simultaneously, and so a rapid start-up of all workstations 2 is possible with the aid of the time offset.

The mentioned method is so simple that no particular requirements need to be placed on the control unit 4 in order to carry out the method.

In the following description of the alternative exemplary embodiment represented in FIG. 2, identical reference numerals are utilized for features that are identical and/or at least comparable in terms of their design and/or mode of operation as compared to the first exemplary embodiment represented in FIG. 1. Provided said features are not explained in detail once again, their design and/or mode of operation correspond/corresponds to the design and mode of operation of the features already described above.

Figure 2:
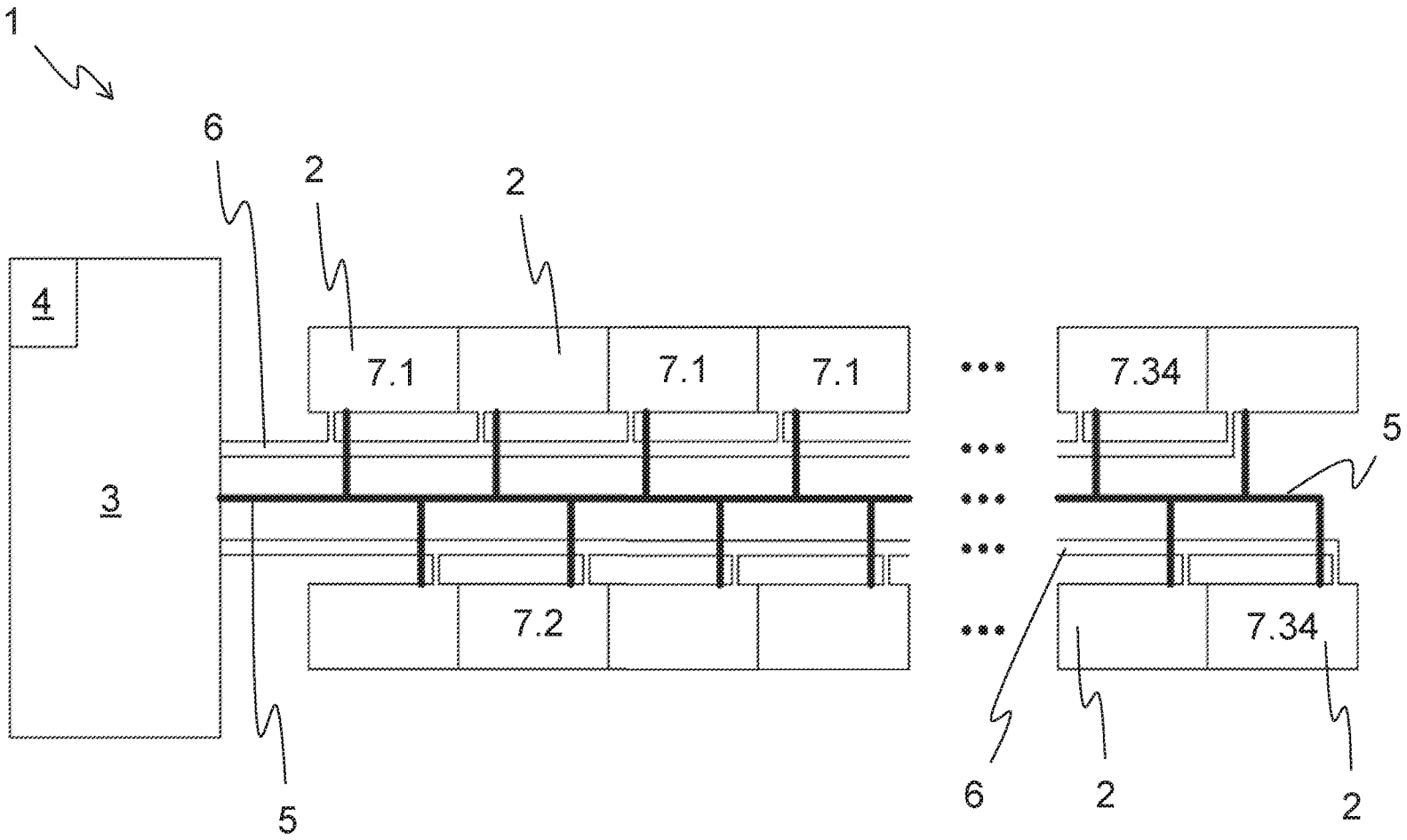
FIG. 2 shows a schematic top view of a further textile machine.

In the exemplary embodiment shown in FIG. 2, the workstations 2 have been divided into groups 7 of workstations 2, which were determined as a function of status data of the textile machine. The particular group 7.1, 7.2, etc., to which the workstation 2 has been assigned is noted in the particular workstation 2. Workstations 2 without a number of a group 7 do not require a start-up, for example, because they are already running in the normal operating mode or they have a fault, which must be eliminated before a start-up.

Other status data, which can affect the assignment of workstations 2 to groups 7, are, for example, the resources of the textile machine 1 and/or parameters of the spun or wound yarn. By incorporating these status data, the assignment of workstations 2 to groups 7 can take place in such a way that the start-up of the workstations 2 can take place even faster.

Moreover, the number of workstations 2 per group 7, and the waiting time between the start-up of a group 7 and the subsequent group 7 can be determined as a function of the status data of the textile machine 1.

In summary, the method according to the invention, which is simple and uncomplicated, allows for a rapid start-up of workstations 2 after a stoppage of these workstations 2.

The present invention is not limited to the represented and described exemplary embodiments. Modifications within the scope of the claims are also possible, as is any combination of the features, even if they are represented and described in different exemplary embodiments.

LIST OF REFERENCE NUMERALS

1 textile machine
2 workstation
3 machine head
4 control unit
5 power cable
6 compressed air pipe
7 group

The invention claimed is:

1. A method for operating a textile machine having a plurality of identical workstations wherein, during a normal operation of the workstations, yarn is produced or rewound from a supply bobbin onto a receiving bobbin at the workstations, the method comprising:

at a plurality of the workstations, after a stoppage, starting and setting the plurality of workstation into a normal operating mode;

wherein the plurality of workstations are divided into groups of workstations, wherein each group of workstations includes at least two of the workstations, and the groups of workstations are started at different predefined times.

2. The method as in claim 1, wherein the different predefined times is a predefined waiting time between start-up of consecutive ones of the groups of workstations.

3. The method as in claim 2, wherein the predefined waiting time is adjustable and determined as a function of status data of the textile machine.

4. The method as in claim 1, wherein the groups of workstations are fixed and predefined.

5. The method as in claim 1, wherein the groups of workstations are determined as a function of status data of the textile machine.

6. The method as in claim 1, wherein a sequence in which the groups of workstations are started is predefinable.

7. The method as in claim 1, wherein a sequence in which the groups of workstations are started is determined as a function of status data of the textile machine.

8. The method as in claim 1, wherein any one or combination of a sequence in which the groups of workstations are started, the predefined times between start up of consecutive ones of the groups of work stations, and determination of the groups of work stations are determined as a function of status data of the textile machine, the status data comprising data related to one or both of resources of the textile machine or parameters of the spun or wound yarn.

9. A textile machine, comprising:

a plurality of identical workstations for producing yarn or for rewinding yarn from a supply bobbin onto a receiving bobbin;

a control system, the control system configured to operate the workstations in accordance with the method of claim 1.

10. The textile machine as in claim 9, wherein the control system comprises one central control unit or multiple control units.

11. The textile machine as in claim 9, further comprising one or more sensors in communication with the control system, the sensors configured to gather status data of the textile machine.

* * * * *